US012539011B2

(12) United States Patent
Kramer

(10) Patent No.: US 12,539,011 B2
(45) Date of Patent: Feb. 3, 2026

(54) WAREWASH MACHINE WITH TRAY SUPPORT SYSTEM AND ASSOCIATED RACK TRACK WITH A TRAY SUPPORT

(71) Applicant: ILLINOIS TOOL WORKS INC., Glenview, IL (US)

(72) Inventor: Steven H. Kramer, Osgood, OH (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 314 days.

(21) Appl. No.: 18/187,788

(22) Filed: Mar. 22, 2023

(65) Prior Publication Data

US 2023/0309778 A1 Oct. 5, 2023

Related U.S. Application Data

(60) Provisional application No. 63/326,498, filed on Apr. 1, 2022.

(51) Int. Cl.

| | |
|---|---|
| ***A47L 15/00*** | (2006.01) |
| ***A47L 15/42*** | (2006.01) |
| ***A47L 15/50*** | (2006.01) |

(52) U.S. Cl.

CPC ..... *A47L 15/0081* (2013.01); *A47L 15/4223* (2013.01); *A47L 15/50* (2013.01)

(58) Field of Classification Search

None

See application file for complete search history.

(56) References Cited

U.S. PATENT DOCUMENTS

| | | | | |
|---|---|---|---|---|
| 7,857,146 | B2 * | 12/2010 | Disch | A47L 15/505 211/41.3 |
| 2009/0320883 | A1 * | 12/2009 | Falk | A47L 15/241 134/133 |
| 2017/0367557 | A1 | 12/2017 | Anim-Mensah | |
| 2019/0000300 | A1 | 1/2019 | Anim-Mensah | |
| 2019/0046002 | A1 | 2/2019 | Fischer | |
| 2019/0191958 | A1 | 6/2019 | Carpenter | |
| 2020/0060505 | A1 | 2/2020 | Jarjour | |
| 2021/0015339 | A1 | 1/2021 | Fischer | |
| 2021/0393105 | A1 | 12/2021 | Carpenter | |
| 2022/0061626 | A1 | 3/2022 | Carpenter | |

* cited by examiner

*Primary Examiner* — Rita P Adhlakha

(74) *Attorney, Agent, or Firm* — THOMPSON HINE LLP

(57) ABSTRACT

A warewash machine includes a housing at least in part defining a treatment chamber having an access opening, a hood mounted for movement between a closed position for washing and an open position for inlet and outlet of wares through the access opening, at least one nozzle for emitting liquid into the treatment chamber, and a rack track positioned within the treatment chamber for having a dish rack rest thereon. A tray support is mounted for movement relative to the rack track between a lowered position and a raised position, in the lowered position the tray support is at or below a rack support plane defined by the rack track, in the raised position at least part of the tray support is located above the rack support plane. The rack track may be a wire or rod form frame configuration with the tray support mounted thereto.

19 Claims, 10 Drawing Sheets

WAREWASH MACHINE WITH TRAY SUPPORT SYSTEM AND ASSOCIATED RACK TRACK WITH A TRAY SUPPORT

TECHNICAL FIELD

This application relates general to machines for washing wares, and more particularly to hood-type warewash machines.

BACKGROUND

Warewash machines are frequently used by commercial enterprises, such as restaurants and cafeterias, for washing relatively large and high numbers of wares. Often, the wares are placed in a rack for ease of handling and to maintain separation between the wares during washing. Some warewash machines, such as hood-type machines, have front and side access openings to the treatment chamber so that the wares do not have to be removed from the treatment chamber through the same access opening through which they were placed into the treatment chamber. A rack track is located in the machine to facilitate sliding movement of the ware racks into and out of the machine, when the door/hood of the machine is raised, and to support the rack in the machine during cleaning operations. A sump/tank below the rack track forms part of the wash spray system, in which washing liquid sprayed from one or more wash arms in the machine and the sprayed wash liquid falls down into the sump and is then recirculated back to the spray arm(s) by a pump.

In certain commercial enterprises, large trays are used and limitations of the ware racks prevent such trays from being positioned in or on the ware rack in a manner that permits the door/hood of the machine from being closed.

Accordingly, it would be desirable to implement a system that facilitates loading of a variety of long tray type wares in hood-type warewash machines.

SUMMARY

In one aspect, a warewash machine includes a housing at least in part defining a treatment chamber having an access opening, a hood mounted for movement between a closed position for washing and an open position for inlet and outlet of wares through the access opening, at least one nozzle for emitting liquid into the treatment chamber, and a rack track positioned within the treatment chamber for having a dish rack rest thereon. A tray support is mounted for movement relative to the rack track between a lowered position and a raised position, in the lowered position the tray support is at or below a rack support plane defined by the rack track, in the raised position at least part of the tray support is located above the rack support plane.

In another aspect, a rack track for supporting a ware rack within a treatment chamber of a warewash machine includes a wire or rod form frame including supporting portions that define a rack support plane. A tray support is mounted to the wire or rod form frame for movement between a lowered position and a raised position. In the lowered position the tray support is at or below the rack support plane, and in the raised position at least part of the tray support is located above the rack support plane.

The details of one or more embodiments are set forth in the accompanying drawings and the description below. Other features, objects, and advantages will be apparent from the description and drawings, and from the claims.

DETAILED DESCRIPTION

Figure 1:
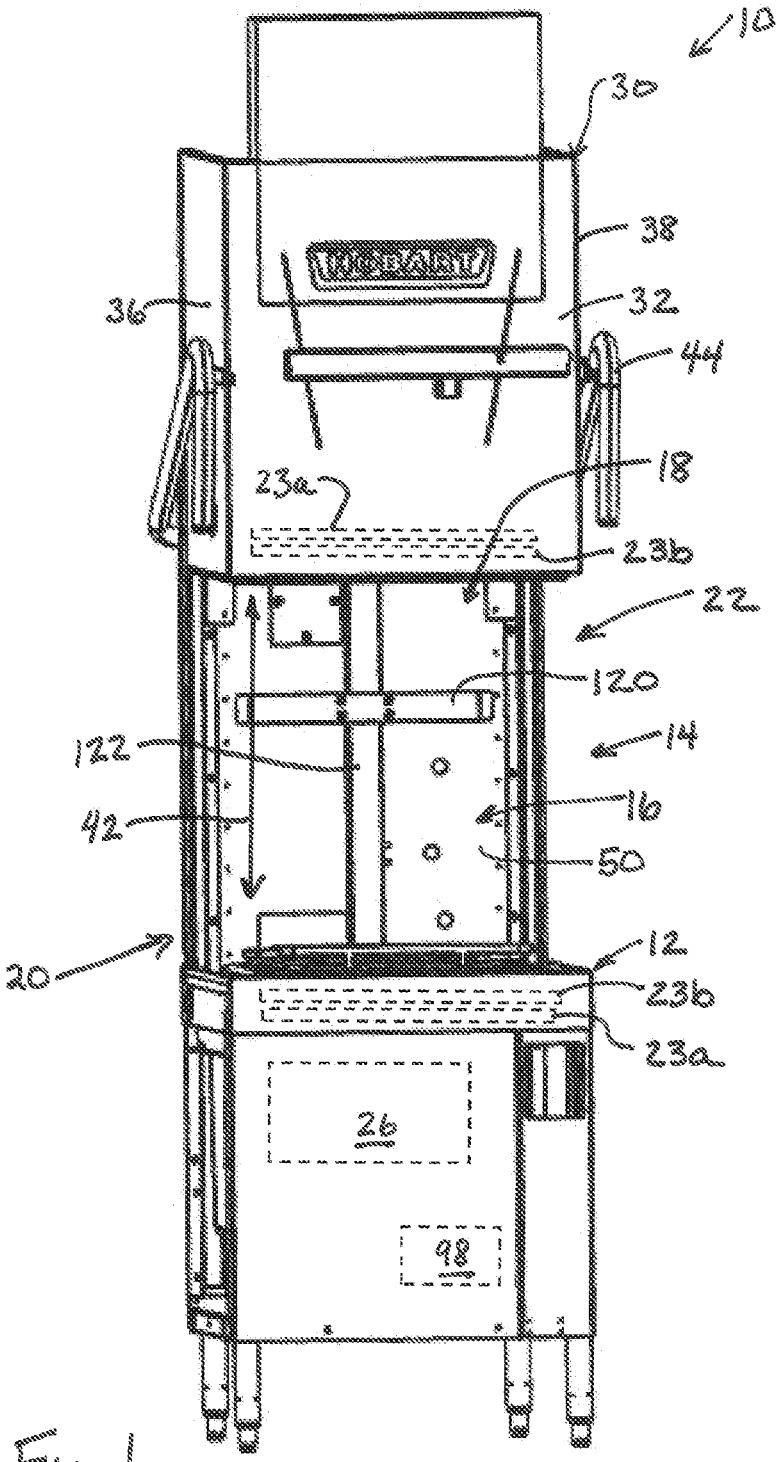
FIGS. 1-3 are perspective views of a hood-type warewash machine or portions thereof.
Figure 2:
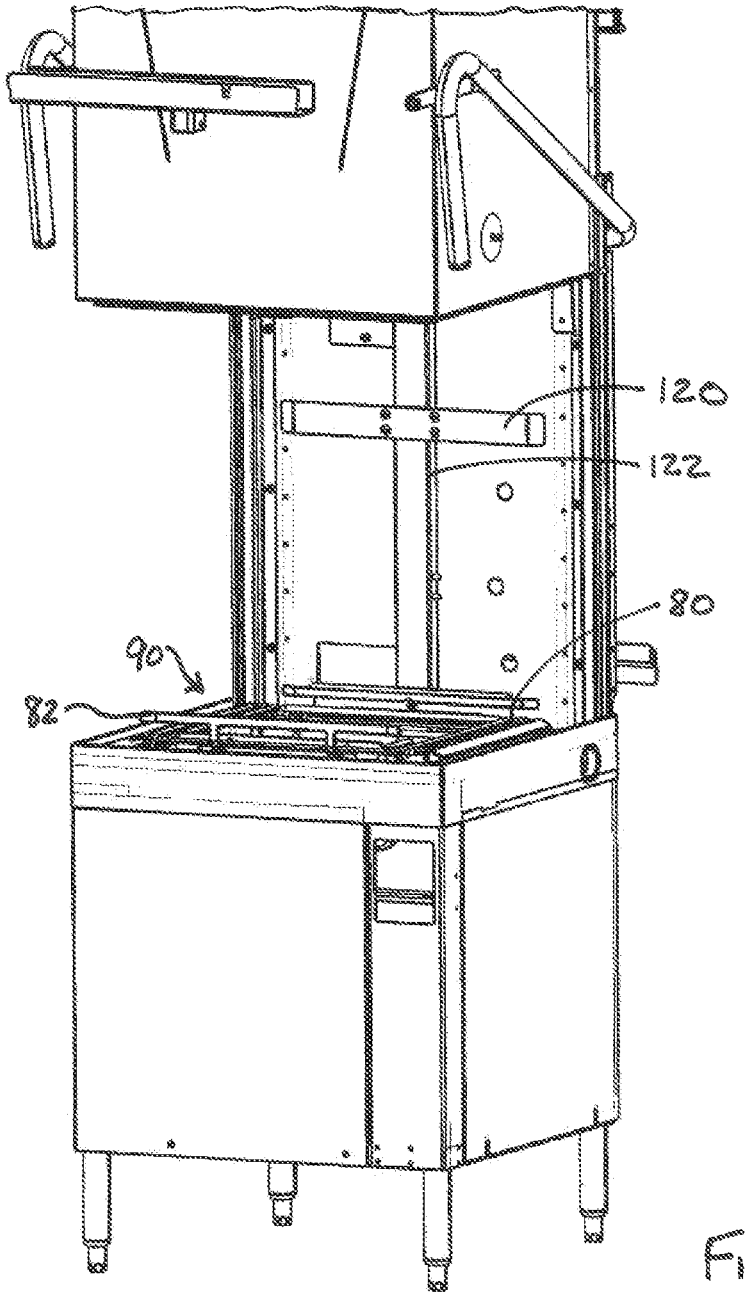
Figure 3:
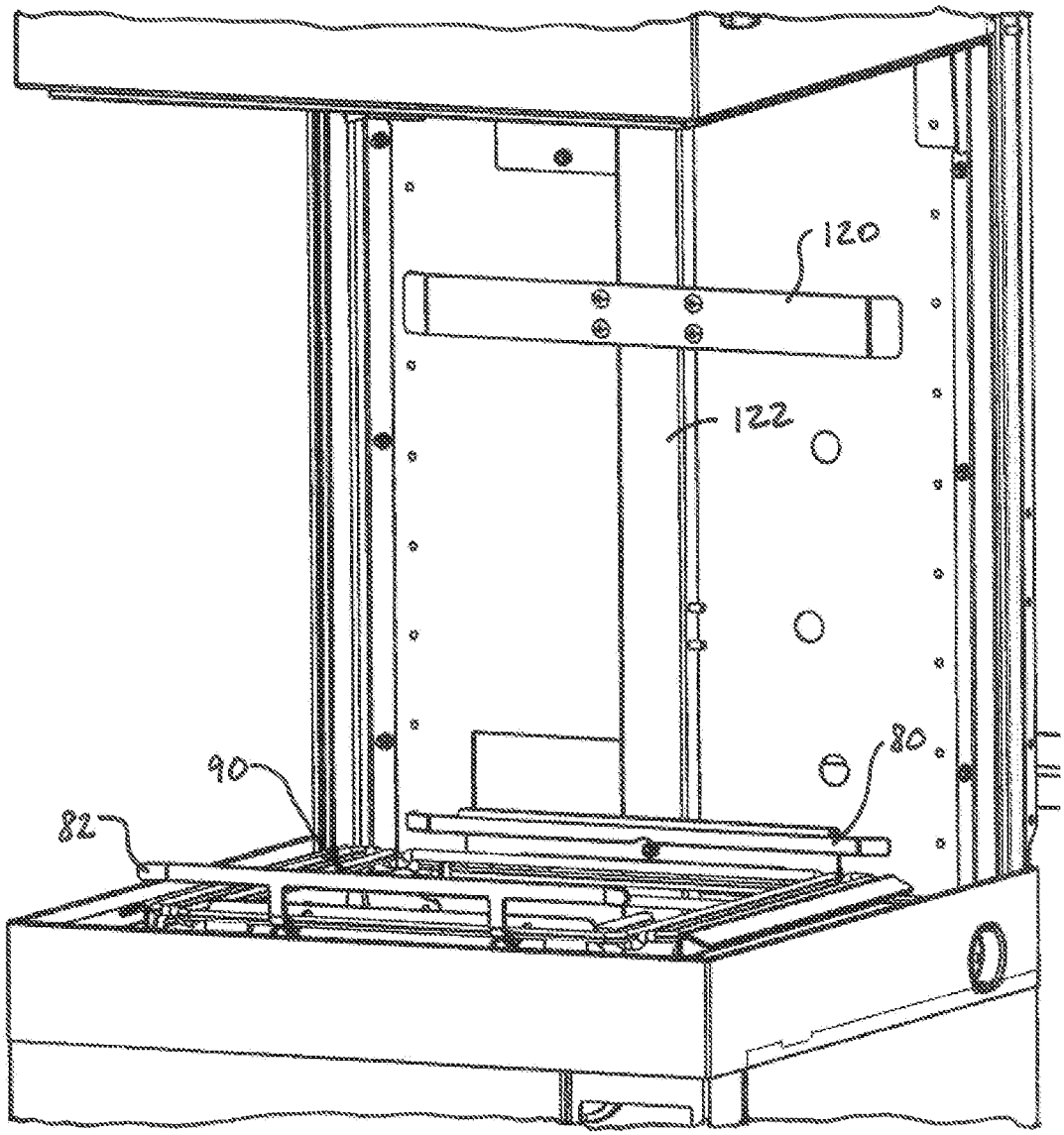

Referring to FIG. 1, a warewash machine 10 includes a housing 12 (e.g., with support frame and panels) in part defining a treatment chamber 14 with a wash zone 16. The chamber 14 includes front 18, left 20 and right 22 access openings through which wares can be moved in and out of the chamber for cleaning. One or more upper and/or lower spray arms (e.g., wash arm(s) 23*a* and rinse arm(s) 23*b* having respective wash nozzles and rinse nozzles) are disposed above and/or below the wash zone. The spray arms are configured to spray liquid toward the wash zone 16. In a typical machine, both wash spray arms 23*a* and rinse spray arms 23*b* may be provided, with the wash spray arms fed by a pump that recirculates liquid from a collection sump or tank 26 below the wash zone, and the rinse spray arms fed by a pump (or line pressure) that delivers hot water from a hot water booster 98. The arms may, for example, be rotating arms and/or fixed arms.

A multi-sided hood assembly 30 includes movable front 32, left 36 and right 38 wall sections (e.g., forming a box-like hood structure that is open at the bottom) and the hood assembly may or may not have a moving top wall section and back wall section. The wall sections move together as a unit, such that the multi-sided hood assembly is movable (per arrow 42) between a lowered closed position for washing and a raised open position (e.g., per FIG. 1) for inlet and outlet of wares. When the multi-sided hood assembly is in the closed position, the hood assembly closes the front 18, left 20 and right 22 access openings so that cleaning sprays within the chamber will be contained during ware cleaning. When the multi-sided hood assembly is in the open position, the front 18, left 20 and right 22 access openings are open to permit access to the wash zone for inlet and egress of wares. A pivot handle 44 may be provided to facilitate operator movement of the hood assembly 30.

A stationary chamber rear wall 50 is disposed at the back or rear side of the treatment chamber and, in embodiments in which the hood assembly includes a rear wall section, the wall 50 is at least partly behind the hood rear wall section when the hood is closed.

A rack track 90 is removably supported at a lower portion of the treatment chamber in a substantially horizontal use orientation by support structure located at both the front and rear of the treatment chamber. By way of example, the support structure may be various internal housing surfaces and/or brackets. The illustrated rack track 90 is of a metal bar or wire form configuration, with upper bar sections aligned to define a rack support surface or rack support plane for a rack containing wares to be cleaned (e.g., dishes, glasses, pots and/or pans etc.). A rear rack slide rail 80 and a forward rack slide rail 82 are shown here, in positions raised relative to the rack support plane, for guiding the sliding movement of a rack from, for example, into the treatment chamber via the left side access opening 20 for cleaning, and then out of the treatment chamber via the right side access opening 22 after ware cleaning.

Figure 4:
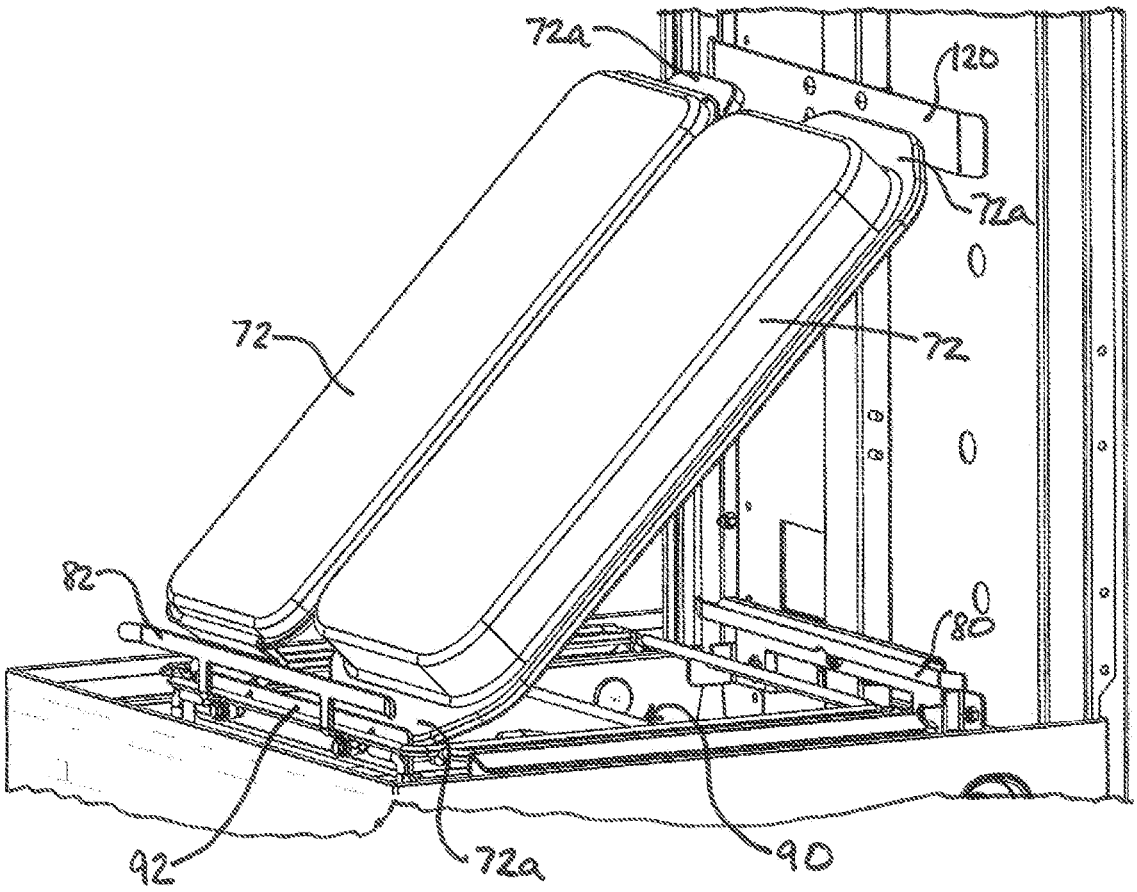
FIG. 4 is a perspective view of the treatment chamber with long trays supported therein.
Figure 5:
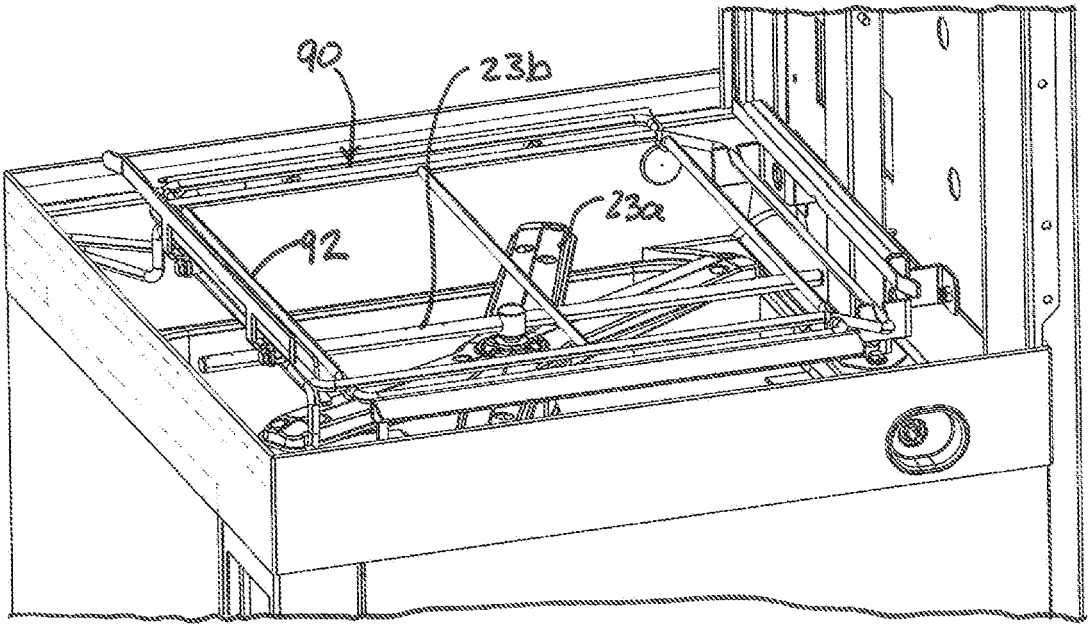
FIGS. 5 and 6 are perspective views of rack track in the treatment chamber with front tray support raised.
Figure 6:
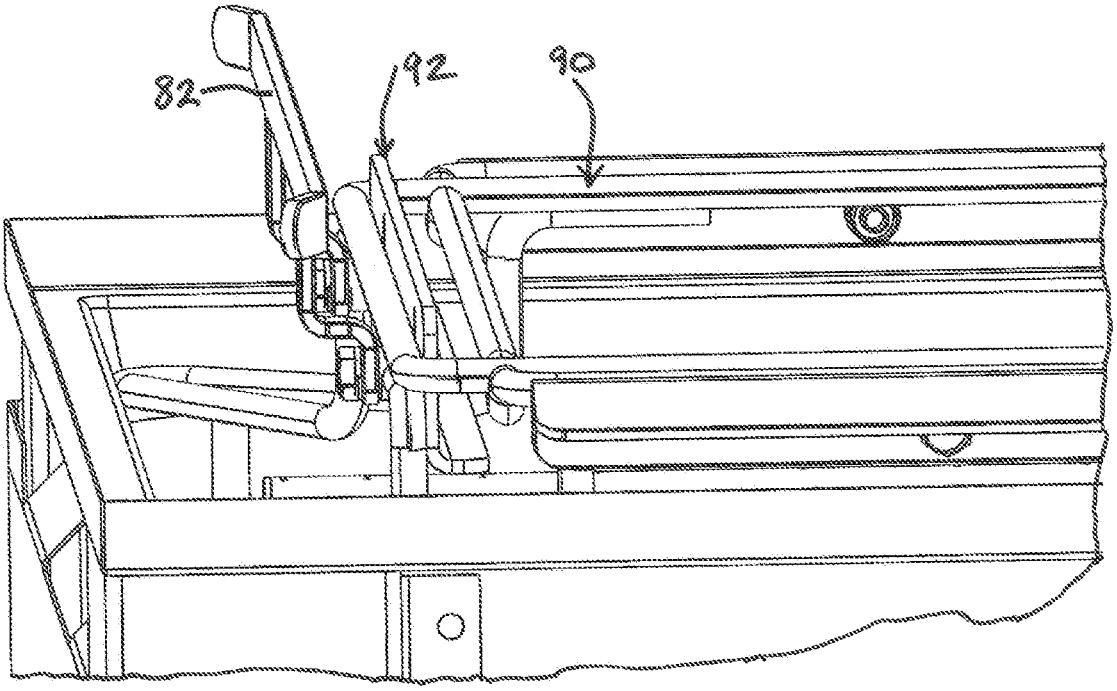
Figure 6A:
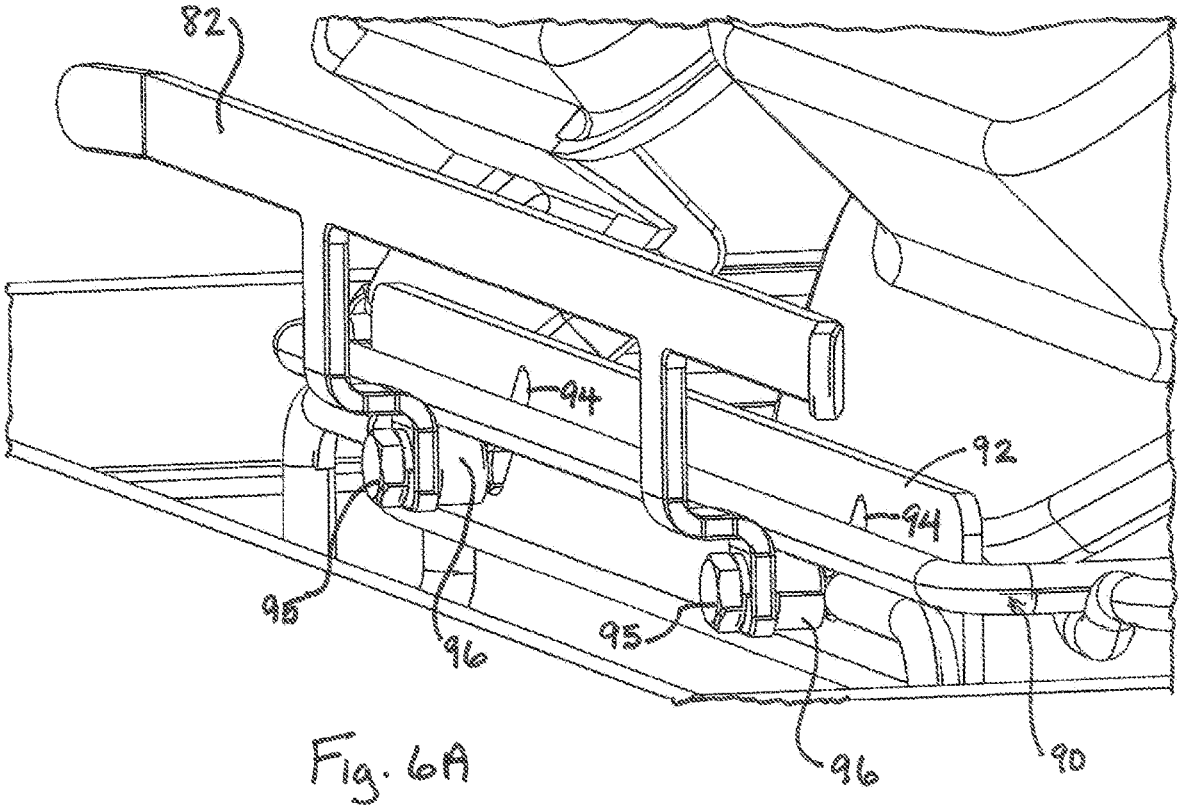
FIG. 6A is a perspective of the rack track in the treatment chamber with front tray support raised and trays engaged therewith.
Figure 7:
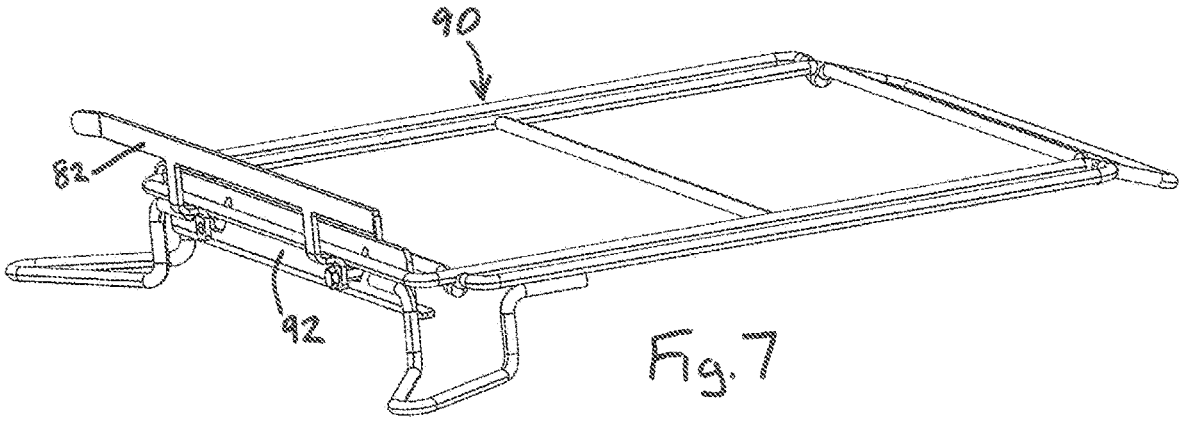
FIGS. 7-9 are perspective views of the rack track, or portions thereof, in isolation.
Figure 8:
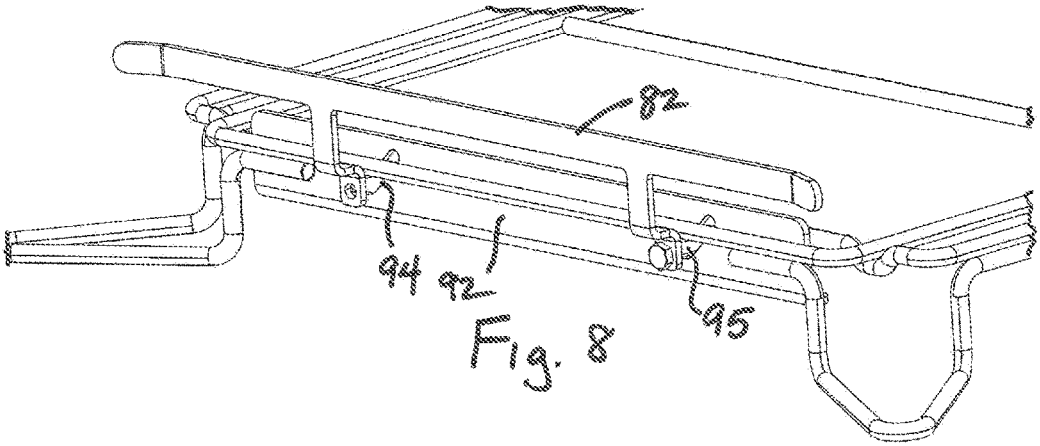
Figure 9:
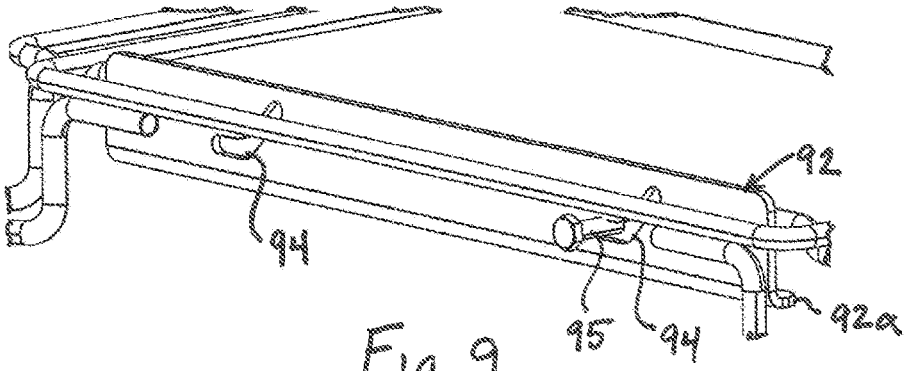
Figure 10A:
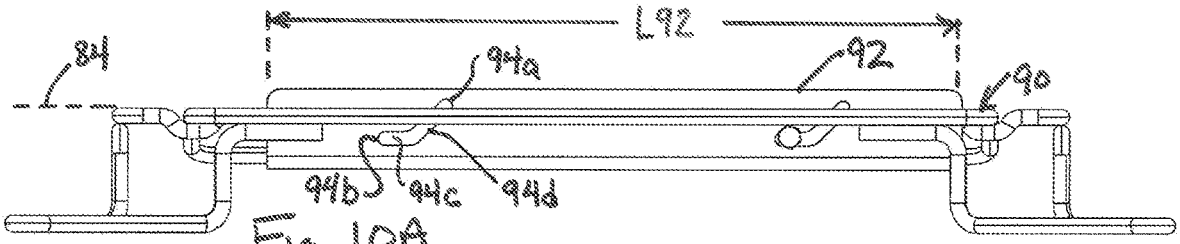
FIGS. 10A and 10B are front elevation views of the rack track with front tray support raised (FIG. 10A) and front tray support lowered (FIG. 10B)
Figure 10B:
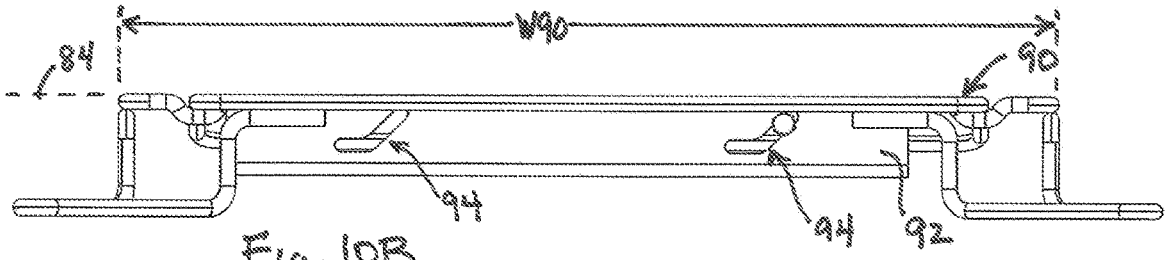
Figure 11A:
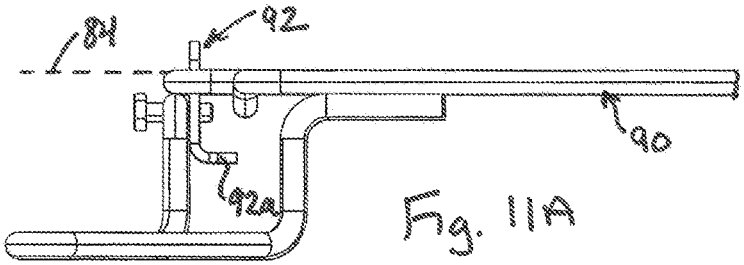
FIGS. 11A and 11B are front elevation views of the rack track with front tray support raised (FIG. 11A) and front tray support lowered (FIG. 11B)
Figure 11B:
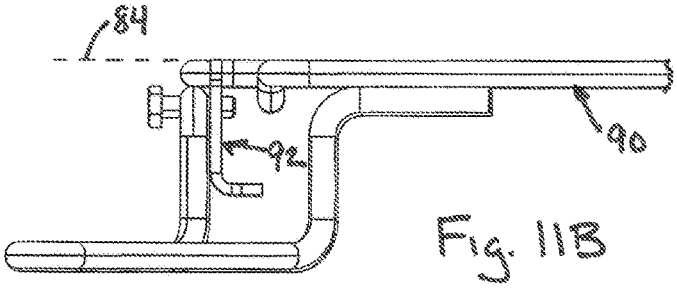
Figure 12:
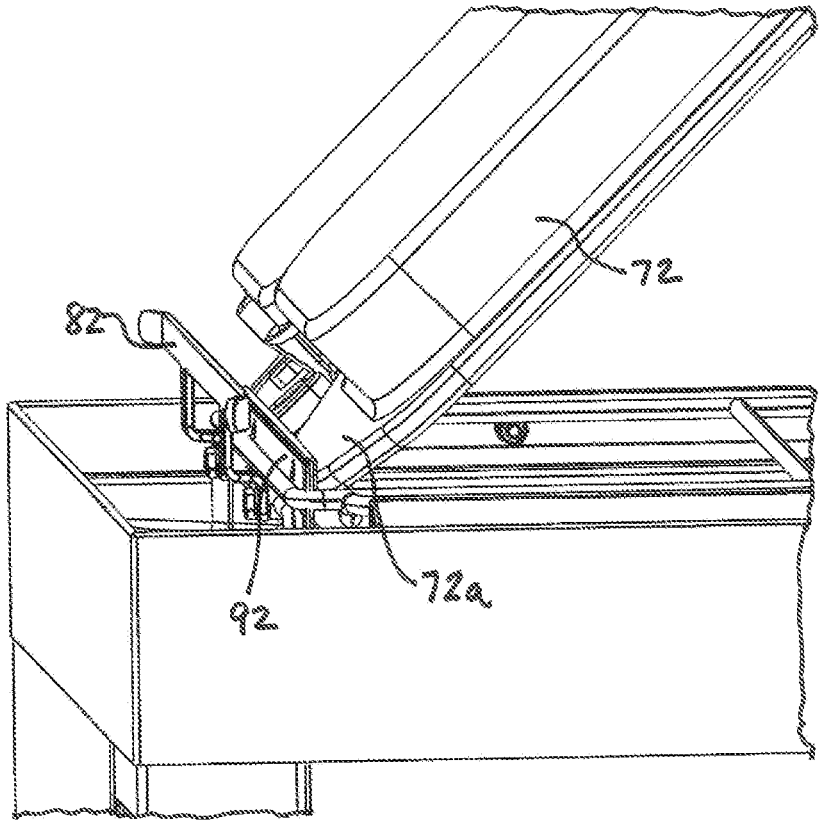
FIGS. 12 and 13 are perspective views of the front portion of the rack track in the treatment chamber with trays supported by the raised front tray support.
Figure 13:
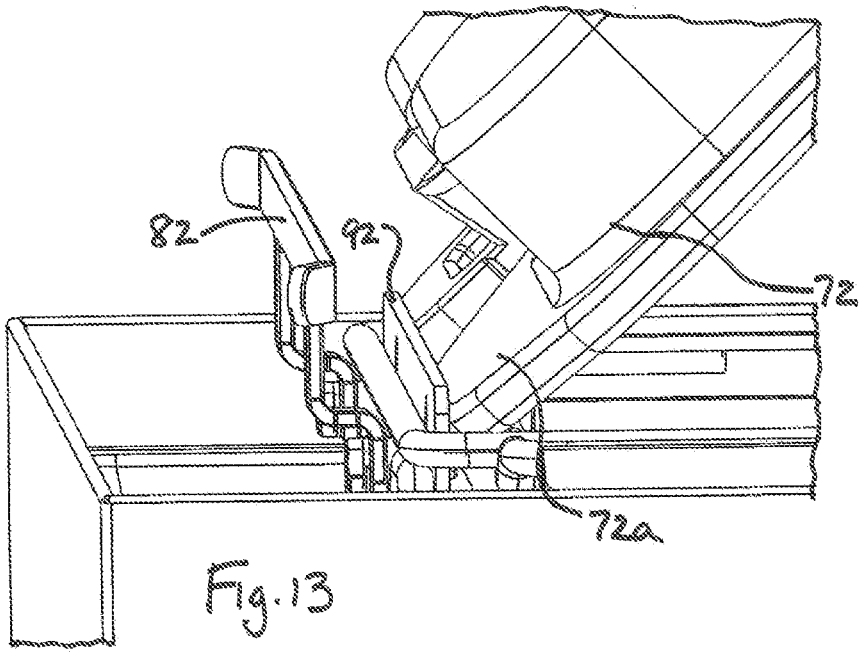

A front tray support 92 is mounted to the front side of the rack track 90 and a rear tray support 120 is mounted to an upwardly extending duct housing 122 (e.g., by fasteners that connect to one or more brackets secured to the housing 122), in which a wash line and/or a rinse line run in order to reach an upper wash arm and/or an upper rinse arm. The front tray support 92 is mounted for movement relative to the rack track 90 between a lowered position (e.g., FIGS. 10B and 11B) and a raised position (e.g., FIGS. 10A and 11A). In the lowered position, the front tray support 92 is at or below a rack support plane 84 defined by the upper bar segments of the rack track. This position allows ware racks to freely slide onto and off the rack track without interference by the front tray support 92. In the raised position, at least part of the front tray support 92 is located above the rack support plane 84, to permit the handle or lip 72*a* of a long tray 72 to be engaged, supported and or captured by or against the front tray support 92 when the long tray 72 is placed in the treatment chamber in an angled position with its upper end (e.g., upper handle or lip) supported on the rear tray support 120, which is spaced forward of the rear wall 50 (e.g., per FIGS. 4, 12 and 13). Thus, the rack track 90 with movable front tray support 92 is configured to facilitate simple and straightforward use for supporting long trays (when the front tray support 92 is raised) and for more typical use for supporting ware racks (when the front tray support 92 is lowered).

Here, the front tray support 92, which may be of a plate configuration, includes guide slots 94 that interact with projecting features of the rack track 90 such that movement of the tray support relative to the projecting feature causes the tray support to shift from the lowered position to the raised position. The projecting features may be fasteners 95 mounted to collars 96 that are, for example, welded to the rack track 90. Thus, the front tray support 92 remains with the rack track even when the rack track is removed from the treatment chamber.

By moving the front tray support 92 laterally along the width of the rack track, the front tray support will be moved upward or downward. In the lowered position of the front tray support 92, the projections are disposed at slot end portion 94*a* of the guide slots 94 and, in the raised position of the front tray support, the projections are disposed at end portion 94*b* of the guide slots. Slot end portion 94*a* is located at the end of a lateral portion 94*c* of the slot, which interacts with the projecting features to prevent the tray support 92 from shifting downward under the force of gravity. The lateral slot portion joins 94*c* joins with a slot portion 94*d* to that angles laterally away and upward toward the slot end portion 94*b*.

In the illustrated embodiment, the fasteners 95 and collars 96 are also used to attach the forward rack slide rail 82 to the rack track 90. In other embodiments, the forward rack slide rail 82 may be absent.

In embodiments, when the front tray support 92 is raised, the portion of the front tray support 92 that is above the rack support plane 84 has a length L92 that is at least 60% (e.g., at least 80%) of a width W90 of the rack supporting surface of the rack track 90, and runs substantially parallel to a direction from a left side to a right side of the rack track 90.

In embodiments, the rear tray support 120 is located at least 10 inches above the rack support plane, such as at least 15 inches above the rack support plane.

Figure 14:
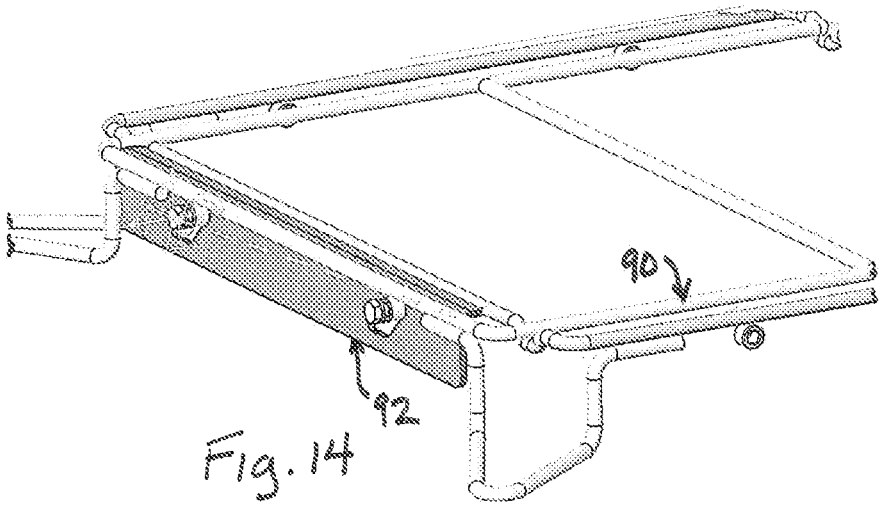
FIGS. 14-15 show perspective views of a rack track with an alternative orientation of the front tray support.
Figure 15:
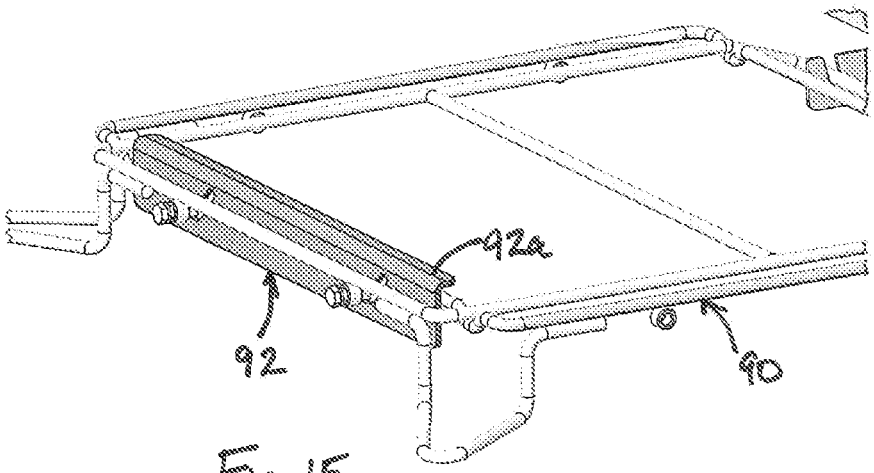

In the illustrated embodiment of FIGS. 1-13, the front tray support 92 is of a plate configuration with an L-shape, where the lateral part 92*a* of the L-shape is located at the bottom of the support, to provide a corner region facing the treatment chamber and into which a tray handle or lip can sit. In an alternative embodiment, per FIGS. 14 and 15, the lateral part 92*a* of the L-shape may be located at the upper part of the support. Other embodiments, such as where the front tray support 92 is planar, are also possible.

It is to be clearly understood that the above description is intended by way of illustration and example only, is not intended to be taken by way of limitation, and that other changes and modifications are possible. For example, the front tray support could be alternatively mounted, such as pivotably, the rack track.

The invention claimed is:

1. A warewash machine, comprising:

a housing at least in part defining a treatment chamber having an access opening;

a hood mounted for movement between a closed position for washing and an open position for inlet and outlet of wares through the access opening;

at least one nozzle configured and positioned for emitting liquid into the treatment chamber;

a rack track positioned within the treatment chamber and defining a rack support surface configured to support a dish rack thereon;

a tray support mounted for movement relative to the rack track, while the rack support surface remains stationary, between a lowered position and a raised position, in the lowered position the tray support is at or below the rack support surface defined, in the raised position at least part of the tray support is located above the rack support surface.

2. The warewash machine of claim 1, wherein the tray support is movably mounted to the rack track so as to remain with the rack track when the rack track is removed from the treatment chamber.

3. The warewash machine of claim 2, wherein the tray support includes at least one guide slot that interacts with a projecting feature of the rack track such that movement of the tray support relative to the projecting feature causes the projecting feature to move along the guide slot to cause the tray support to shift from the lowered position to the raised position.

4. The warewash machine of claim 3, wherein the tray support comprises an elongated plate member and the projecting feature comprises a fastener mounted to a collar on the rack track.

5. The warewash machine of claim 1, wherein the tray support comprises an elongated plate member mounted toward a front side of the rack track.

6. The warewash machine of claim 5, wherein the plate member has a length that extends substantially parallel to a direction from a left side to a right side of the rack track.

7. The warewash machine of claim 1, wherein the plate member is bent or angled to form an L-shape.

8. The warewash machine of claim 1, wherein, when tray support is in the raised position, the part of the tray support that is above the rack support surface has a length that is at least 60% of a width of the rack support surface.

9. The warewash machine of claim 1, wherein, when tray support is in the raised position, the part of the tray support that is above the rack support surface has a length that is at least 80% of a width of the rack support surface.

10. The warewash machine of claim 1, wherein the tray support is a front tray support mounted toward a front side of the treatment chamber, the machine further comprising a rear tray support mounted toward a rear side of the treatment chamber, the rear tray support is located above the rack support surface.

11. The warewash machine of claim 10, wherein the rear tray support is located at least 15 inches above the rack support surface.

12. The warewash machine of claim 10, wherein at least one tray is supported in the treatment chamber for cleaning by engagement of a lower end of the tray with the front tray support and engagement of an upper end of the tray with the rear tray support.

13. The warewash machine of claim 1, wherein the rack support surface lies in a substantially horizontal plane when the tray support is in the lowered position, and the rack support surface lies in the substantially horizontal plane when the tray support is in the raised position, and the tray support moves upwardly through an open region of the rack track when moving from the lowered position to the raised position.

14. The warewash machine of claim 1, wherein the treatment chamber includes a front side, a rear side, a left side and a right side, and the tray support shifts laterally, relative to the left side and the right side, when the tray support moves between the lowered position and the raised position.

15. A warewash machine, comprising:

a housing at least in part defining a treatment chamber having an access opening;

a hood mounted for movement between a closed position for washing and an open position for inlet and outlet of wares through the access opening;

at least one nozzle configured and positioned for emitting liquid into the treatment chamber;

a rack track positioned within the treatment chamber for having a dish rack rest thereon;

a tray support mounted for movement relative to the rack track between a lowered position and a raised position, in the lowered position the tray support is at or below a rack support plane defined by the rack track, in the raised position at least part of the tray support is located above the rack support plane;

wherein the tray support is a front tray support mounted toward a front side of the treatment chamber, the machine further comprising a rear tray support mounted toward a rear side of the treatment chamber, the rear tray support is located above the rack support plane;

wherein the rear tray support is mounted to an upwardly extending duct housing in which a wash line and/or a rinse line run in order to reach an upper wash arm and/or an upper rinse arm.

16. A warewash machine, comprising:

a housing at least in part defining a treatment chamber having an access opening, the treatment chamber including a front side and a rear side;

a hood mounted for movement between a closed position for washing and an open position for inlet and outlet of wares through the access opening;

at least one nozzle configured and positioned for emitting liquid into the treatment chamber;

a rack track positioned within the treatment chamber and defining a rack support surface configured to support a dish rack thereon;

a tray support mounted to the rack track for movement relative to the rack track, between a lowered position and a raised position, in the lowered position the tray support is at or below the rack support surface, in the raised position at least part of the tray support is located above the rack support surface, wherein the tray support moves upwardly through an open region of the rack track when moving from the lowered position to the raised position.

17. The warewash machine of claim 16, wherein the rack support surface lies in a substantially horizontal plane when the tray support is in the lowered position, and the rack support surface lies in the substantially horizontal plane when the tray support is in the raised position.

18. The warewash machine of claim 16, wherein the treatment chamber includes a left side and a right side, and the tray support shifts laterally, relative to the left side and the right side, when the tray support moves between the lowered position and the raised position.

19. The warewash machine of claim 16, wherein the tray support includes at least one guide slot that interacts with a projecting feature of the rack track such that movement of the tray support relative to the projecting feature causes the projecting feature to move along the guide slot to cause the tray support to shift from the lowered position to the raised position.

* * * * *